US010886658B2

(12) United States Patent
Xu

(10) Patent No.: US 10,886,658 B2
(45) Date of Patent: Jan. 5, 2021

(54) MOBILE SOCKET DEVICE THAT CAN BE QUICKLY FIXED AND DISASSEMBLED

(71) Applicant: Guangdong BESTEK Medical Devices Co., Ltd, Shenzhen (CN)

(72) Inventor: Xinhua Xu, Shenzhen (CN)

(73) Assignee: GUANGDONG BESTEK MEDICAL DEVICES CO., LTD, Shenzhen (CN)

( * ) Notice: Subject to any disclaimer, the term of this patent is extended or adjusted under 35 U.S.C. 154(b) by 0 days.

(21) Appl. No.: 16/493,313

(22) PCT Filed: Apr. 25, 2017

(86) PCT No.: PCT/CN2017/081784
§ 371 (c)(1),
(2) Date: Sep. 12, 2019

(87) PCT Pub. No.: WO2018/166043
PCT Pub. Date: Sep. 20, 2018

(65) Prior Publication Data

US 2020/0076113 A1 Mar. 5, 2020

(30) Foreign Application Priority Data

Mar. 17, 2017 (CN) ..... 2017 2 0267763 U

(51) Int. Cl.
*H01R 13/506* (2006.01)
*H01R 13/73* (2006.01)
*H01R 27/02* (2006.01)

(52) U.S. Cl.
CPC ..... *H01R 13/506* (2013.01); *H01R 13/73* (2013.01); *H01R 27/02* (2013.01)

(58) Field of Classification Search
CPC .... H01R 25/006; H01R 13/18; H01R 13/748; H01R 13/7032; H01R 13/745; H01R 27/02; H01R 13/73; H01R 13/506
(Continued)

(56) References Cited

U.S. PATENT DOCUMENTS

2007/0093126 A1* 4/2007 Tsuo ..... H01R 13/748
439/563
2012/0164861 A1* 6/2012 Chuang ..... H01R 13/7032
439/188
2018/0198229 A1* 7/2018 Cheng ..... H01R 13/18

FOREIGN PATENT DOCUMENTS

CN 201466311 U 5/2010
CN 202678606 U 1/2013
(Continued)

OTHER PUBLICATIONS

International Search Report for PCT/CN2017/081784.
(Continued)

*Primary Examiner* — Jean F Duverne

(57) ABSTRACT

Disclosed is a mobile socket device that can be quickly fixed and disassembled, including a socket and a fixed socket. The socket has a placement surface provided with a clamp hole, and at least one power collecting surface each provided with at least one set of jacks. The fixed seat has a receiving surface provided with a buckle buckled with the clamp hole, and a mounting surface suitable for being mounted to a carrier. The mobile socket device takes into account the advantages of both a fixed socket and a mobile socket. On the one hand, the socket can be fixed in any place at any time through the fixed socket. On the other hand, the socket can be removed from the fixed seat and used as a mobile socket. In addition, the socket and the fixed seat are connected by buckle connection, facilitating mounting and disassembly.

20 Claims, 4 Drawing Sheets

(58) Field of Classification Search
USPC ..... 439/571
See application file for complete search history.

(56) References Cited

FOREIGN PATENT DOCUMENTS

| | | | |
|---|---|---|---|
| CN | 204304180 | U | 4/2015 |
| CN | 105576444 | A | 5/2016 |
| TW | M491978 | U | 12/2014 |

OTHER PUBLICATIONS

International Publication for PCT/CN2017/081784.
Written Opinion of the International Search Authority for PCT/CN2017/081784.

* cited by examiner

MOBILE SOCKET DEVICE THAT CAN BE QUICKLY FIXED AND DISASSEMBLED

TECHNICAL FIELD

The present utility model relates to a power socket, and in particular to a mobile socket device that can be quickly fixed and disassembled.

BACKGROUND

Nowadays, electrical apparatuses are closely related to people's lives, making sockets become indispensable daily necessities. Currently, sockets are divided into fixed sockets and movable sockets. Fixed sockets are usually fixedly arranged on fixed surfaces such as walls. The immovable feature of the fixed sockets limits their working range, while movable sockets which need to carry long cables with them are often placed arbitrarily on the floor as both the sockets and the cable cannot be fixed, bringing a large number of security risks to daily life.

SUMMARY

The present utility model aims at solving one of the technical problems in the related technology at least partially. Therefore, one of the purposes of the present utility model is to provide a mobile socket device that can be quickly fixed and disassembled.

To achieve the above purpose, a mobile socket device that can be quickly fixed and disassembled according to an embodiment of the present utility model comprises:

a socket having a placement surface and at least one power collecting surface, wherein the placement surface is provided with a clamp hole, and each power collecting surface is provided with at least one set of jacks; and a fixed seat having a receiving surface and a mounting surface, wherein the receiving surface is provided with a buckle buckled with the clamp hole, and the mounting surface is suitable for being mounted to a carrier.

The mobile socket device that can be quickly fixed and disassembled according to the embodiment of the present utility model takes into account the advantages of both a fixed socket and a mobile socket. On the one hand, the socket can be fixed in any place at any time through the fixed seat, such as a back or side of a table, and other areas that will not affect life or work, so as to avoid accidents caused by unintentional touches and improve use security. On the other hand, the socket can be removed from the fixed seat and used as a mobile socket to ensure flexible use thereof In addition, the socket and the fixed seat are connected by buckling, facilitating mounting and disassembly.

Further, the mobile socket device that can be quickly fixed and disassembled according to the above embodiment of the present utility model may have the following additional technical features:

according to one embodiment of the present utility model, the buckle is configured to be slidable between a first position and a second position on the fixed seat;

the fixed seat is provided thereon with an unlocking member for driving the buckle to slide between the first position and the second position, and when the buckle is located at the first position, it is buckled with the clamp hole, while when the buckle is located at the second position, it is detached from the clamp hole.

According to one embodiment of the present utility model, the unlocking member comprises:

a pressure button for a user to operate to exert a pressure, the buckle being connected to the pressure button; and an elastic member connected to the pressure button to provide an elastic effect such that the buckle remains at the first position.

According to one embodiment of the present utility model, the receiving surface is provided with an accommodating slot to accommodate at least a portion of the socket.

According to one embodiment of the present utility model, the fixed seat comprises:

an upper housing having the receiving surface which is provided with a travel hole defining the first position and the second position; and a lower housing connected to the upper housing and provided therein with a slideway which is provided therein with a slider, the buckle being arranged on the slider and extending from the travel hole to the accommodating slot, the pressure button being arranged on the slider and at least partially exposed out from the fixed seat, and the elastic member being arranged in the lower housing.

According to one embodiment of the present utility model, two clamp holes are oppositely arranged to each other, and two buckles are arranged in one-to-one correspondence with the two clamp holes, the two buckles having opposite elastic reset directions.

According to one embodiment of the present utility model, four clamp holes are oppositely arranged to each other in pairs, and among the four clamp holes, a distance between the two clamp holes in one pair of oppositely arranged clamp holes is equal to a distance between the two clamp holes in the other pair of oppositely arranged clamp holes; and two buckles are arranged in one-to-one correspondence with the two clamp holes in any pair of oppositely arranged clamp holes and have opposite elastic reset directions.

According to one embodiment of the present utility model, the receiving surface is provided with a countersunk hole penetrating therethrough to the mounting surface, the countersunk hole being provided therein with a bolt suitable for mounting the fixed seat to the carrier.

According to one embodiment of the present utility model, the mounting surface is provided with any one selected from a group consisting of double-sided glue, a magic sticker, and a magnetic member.

According to one embodiment of the present utility model, the jacks comprise DC jacks and/or AC jacks.

The additional aspects and advantages of the present utility model will be partially provided in the following description, and will partially become apparent from the following description or be understood through the practice of the present utility model.

Figure 1:
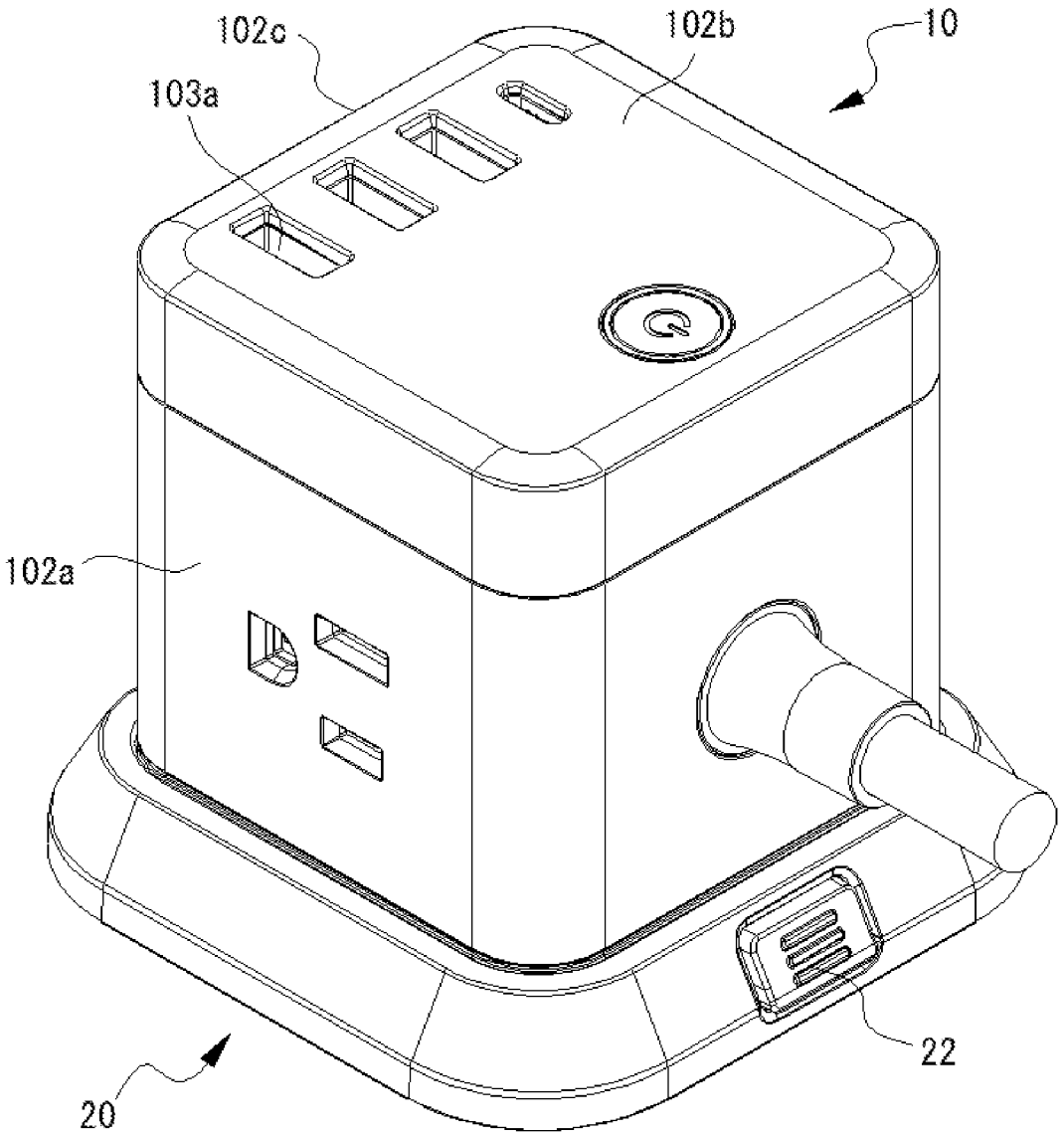
FIG. 1 schematically shows the structure of a mobile socket device that can be quickly fixed and disassembled according to an embodiment of the present utility model.

LIST OF REFERENCES socket 10;
placement surface 101;
clamp hole 1011;
power collecting surfaces 102*a*, 102*b*, 102*c;*
jacks 103*a*, 103*b;*
fixed seat 20;
upper housing 201;
receiving surface 2011;
accommodating slot 2012;
travel hole 2013;
keyhole 2014;
countersunk hole 2015;
lower housing 202;
slideway 2021;
buckle 21;
barb portion 211;
inclined guide surface S01;
pressure button 22;
elastic member 23;
slider 24; and
vertical axis Z00.

The implementation of the purposes, the functional features, and the advantages of the present utility model will be further explained with reference to the accompanying drawings in combination with embodiments.

DETAILED DESCRIPTION

Embodiments of the present utility model will be described in detail below, and examples of the embodiments are shown in the drawings in which identical or similar signs always represent identical or similar elements or elements with the same or similar functions. The following embodiments described with reference to the drawings are exemplary and are intended to explain the present utility model, but cannot be understand as limitations to the present utility model. All other embodiments obtained by those of ordinary skill in the art based on the embodiments herein without incurring any creative labor fall within the scope of protection of the present utility model.

In the description of the present utility model, it is necessary to understand, orientations or positional relationships indicated by the terms "center," "longitudinal," "transverse," "length," "width," "thickness," "up," "down," "front," "rear," "left," "right," "vertical," "horizontal," "top," "bottom," "inside," "outside," "clockwise," "counterclockwise," "axial," "circumferential," "radial," and the like are based on the orientations or positional relationships shown in the drawings. They are only for the convenience of describing and simplifying the description of the present utility model, but not for indicating or implying that devices or elements referred to must have particular orientations and be configured and operated in particular orientations, and therefore, cannot be understood as limitations to the present utility model.

In addition, the terms "first" and "second" are used only for the purpose of description but cannot be understood as indicating or implying relative importance or implying the number of technical features indicated. As a result, features defined by "first" and "second" may explicitly or implicitly comprise one or more of these features. In the description of the present utility model, "a plurality of" means two or more unless otherwise specified.

In the present utility model, unless otherwise specified and defined, the terms "mounting," "connection," "communication," "fixation," and the like should be understood in a broad sense. For example, it can be fixed connection, removable connection, or integrated connection; mechanical connection or electrical connection; direct connection, indirect connection through intermediate media, or internal communication of two elements. For those of ordinary skill in the art, the particular meanings of the above terms in the present utility model can be understood according to particular circumstances.

In the present utility model, unless otherwise specified and limited, a first feature "above" or "below" a second feature may indicate direct contact between the first and second features, or indirect contact between the first and second features through additional features provided therebetween. Moreover, the first feature "above," "over," or "on" the second feature may indicate that the first feature is directly or obliquely "above," "over," or "on" the second feature, or may simply indicate that the level of the first feature is higher than that of the second feature. The first feature "under," "below," or "beneath" the second feature may indicate that the first feature is directly or obliquely "under," "below," or "beneath" the second feature, or may simply indicate that the level of the first feature is lower than that of the second feature.

A mobile socket device that can be quickly fixed and disassembled according to an embodiment of the present utility model will be described in detail below with reference to the drawings.

Figure 4:
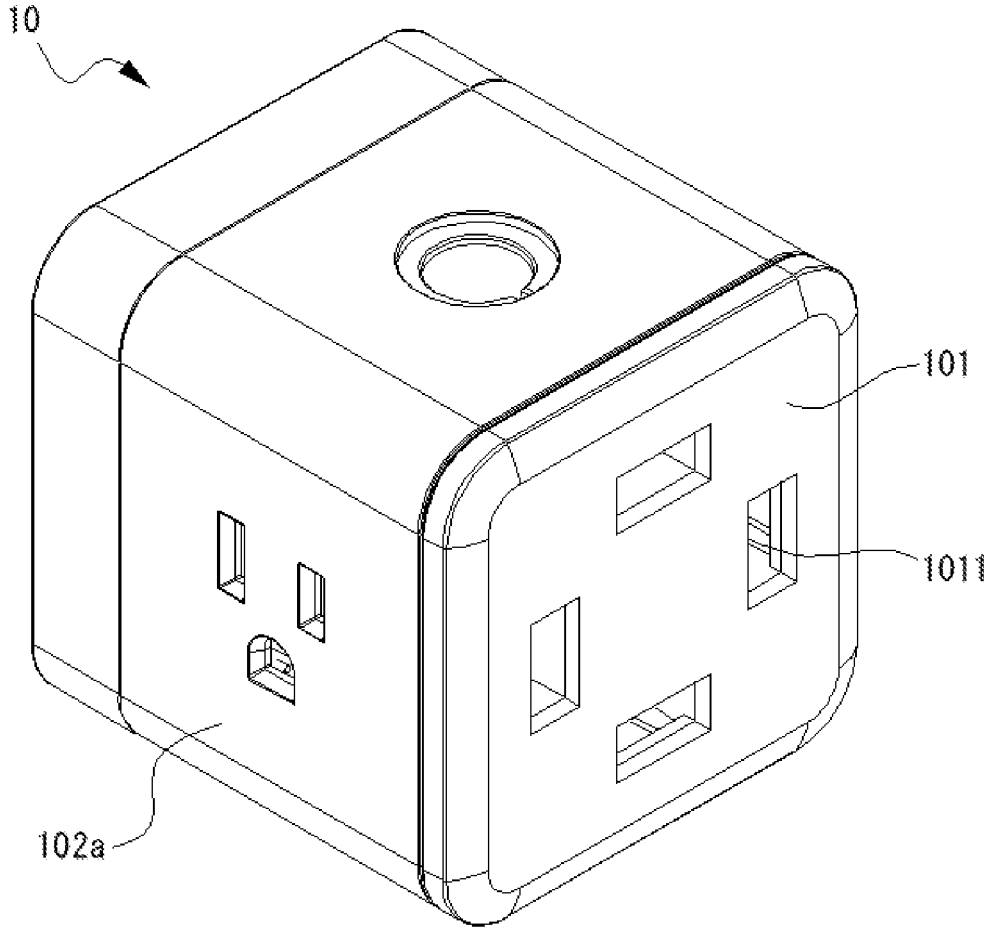
FIG. 4 schematically shows the structure of a socket in the mobile socket device that can be quickly fixed and disassembled according to the embodiment of the present utility model.

As shown in FIGS. 1 and 4, the mobile socket device that can be quickly fixed and disassembled according to the embodiment of the present utility model comprises a socket 10 and a fixed seat 20.

Particularly, the socket 10 has a placement surface 101 and at least one power collecting surface 102*a*, 102*b*, or 102*c*. The placement surface 101 is provided with a clamp hole 1011, and each of the power collecting surfaces 102*a*, 102*b*, and 102*c* is provided with at least one set of jacks 103*a* and 103*b*. In the example shown in FIG. 1, the socket 10 is configured to be a polyhedron, which has a top surface, a bottom surface, and a plurality of sides. The top surface and the sides can be used as the above-mentioned power collecting surfaces 102*a*, 102*b*, and 102*c*. The top surface and the sides are each provided with jacks 103*a* and 103*b*. Power can be obtained upon insertion of a power plug of an electrical device into the jacks 103*a* or 103*b*. And the bottom surface can be used as the above-mentioned placement surface 101. The bottom surface is provided thereon with a square clamp hole 1011.

Advantageously, the jacks 103*a* and 103*b* may comprise DC jacks 103*a* for DC output and AC jacks 103*b* for AC output. In the example as shown in FIG. 1, the DC jacks 103*a* are provide on the top surface, while the AC jacks 103*b* are provided on the sides. Thus, the socket 10 can supply power both for DC devices, such as mobile phones, tablet computers, digital cameras, and other mobile terminals, and for AC devices, such as computers, electric fans, air conditioners, and other household appliances.

Understandably, the socket 10 may also be configured to be in ally other shapes, so long as it has a placement surface 101 and at least one power collecting surface 102*a*, 102*b*, or 102*c*, and positions for the DC jacks 103*a* and AC jacks 103*b* may also be arranged as needed.

The fixed seat 20 has a receiving surface 2011 and a mounting surface. The receiving surface 2011 is provided with a buckle 21 buckled with the clamp hole 1011, and the mounting surface is suitable for being mounted to a carrier. In the example as shown FIG. 1, the fixed seat 20 is configured to be in a square structure the same as a cross section of the socket 10. And the fixed seat 20 has a top surface and a bottom surface, wherein the top surface acts as the above-mentioned receiving surface 2011 provided with the buckle 21 capable of being buckled with the clamp hole 1011, while the bottom surface acts as the mounting surface capable of being mounted and fit to the surface of the carrier. The carrier may be any fixed object, such as a table, a cavity, etc. As an example, the mounting surface of the fixed seat 20 can be mounted to a back or side of a table, or the like.

In other words, the placement surface 101 of the socket 10 is provided with the clamp hole 1011, while the receiving surface 2011 of the fixed seat 20 is provided with the buckle 21. The buckling function between the buckle 21 and the clamp hole 1011 enables the socket 10 to be mounted and fixed to, or disassembled from the fixed seat 20. In a specific example, the buckle 21 can be made of an elastic material. When the socket 10 is being mounted to the fixed seat 20, the buckle 21 undergoes certain elastic deformation, enabling the buckle 21 to buckle into the clamp hole 1011. When the socket 10 is being removed from the fixed seat 20, the buckle 21 also undergoes certain elastic deformation, enabling the buckle 21 to detach from the clamp hole 1011.

According to the mobile socket device that can be quickly fixed and disassembled as provided in the embodiment of the present utility model, the advantages of a fixed socket and a mobile socket are both taken into account. On the one hand, the socket 10 can be fixed in any place at any time through the fixed seat 20, such as a back or side of a table, and other areas that will not affect life or work, so as to avoid accidents caused by unintentional touches and improve use security. On the other hand, the socket 10 can be removed from the fixed seat 20 and used as a mobile socket to ensure flexible use thereof. In addition, the socket 10 and the fixed scat 20 are connected by means of the buckle 21, facilitating mounting and disassembly.

Figure 2:
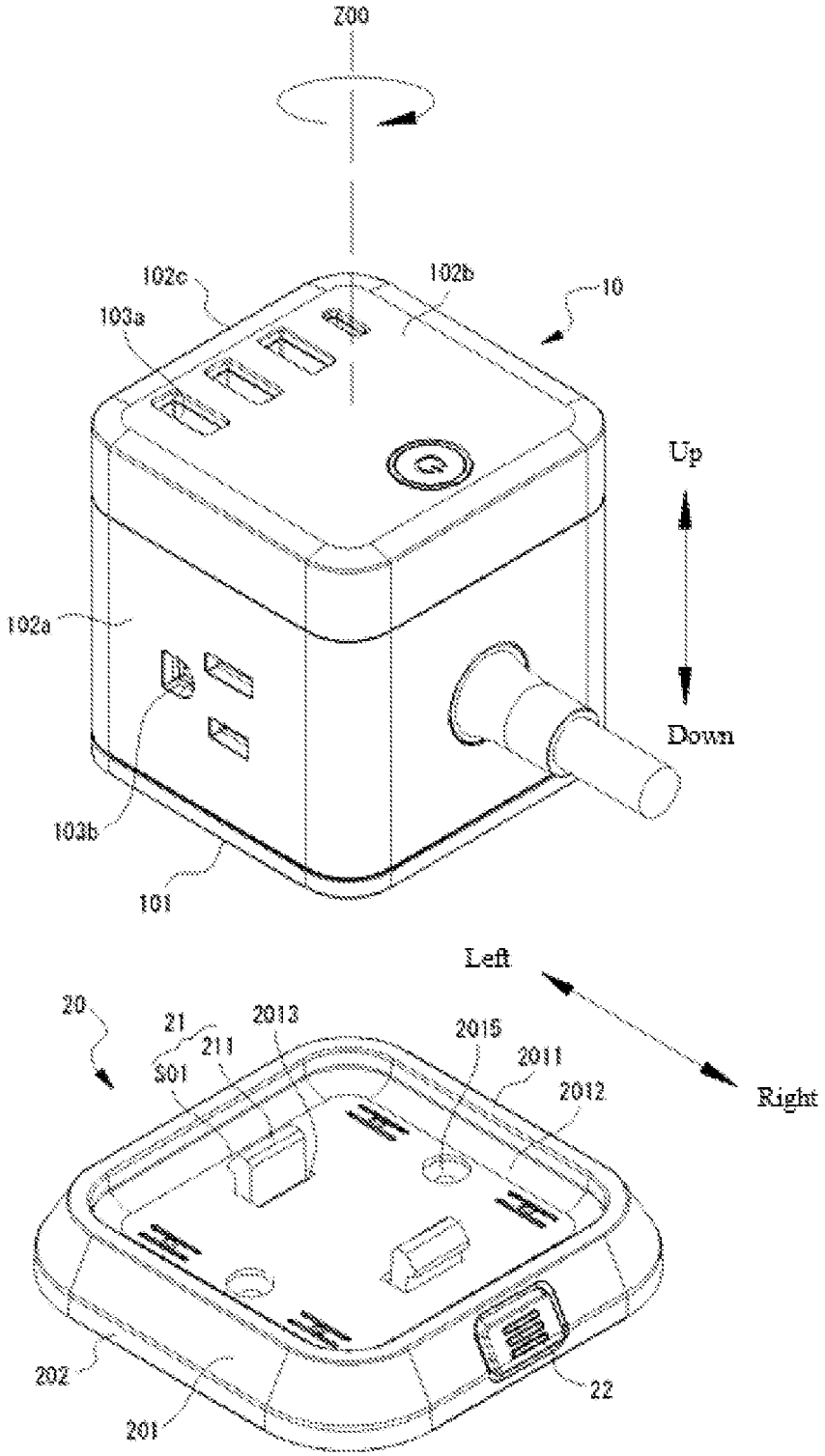
FIG. 2 is an exploded view of the mobile socket device that can be quickly fixed and disassembled according to the embodiment of the present utility model.
Figure 3:
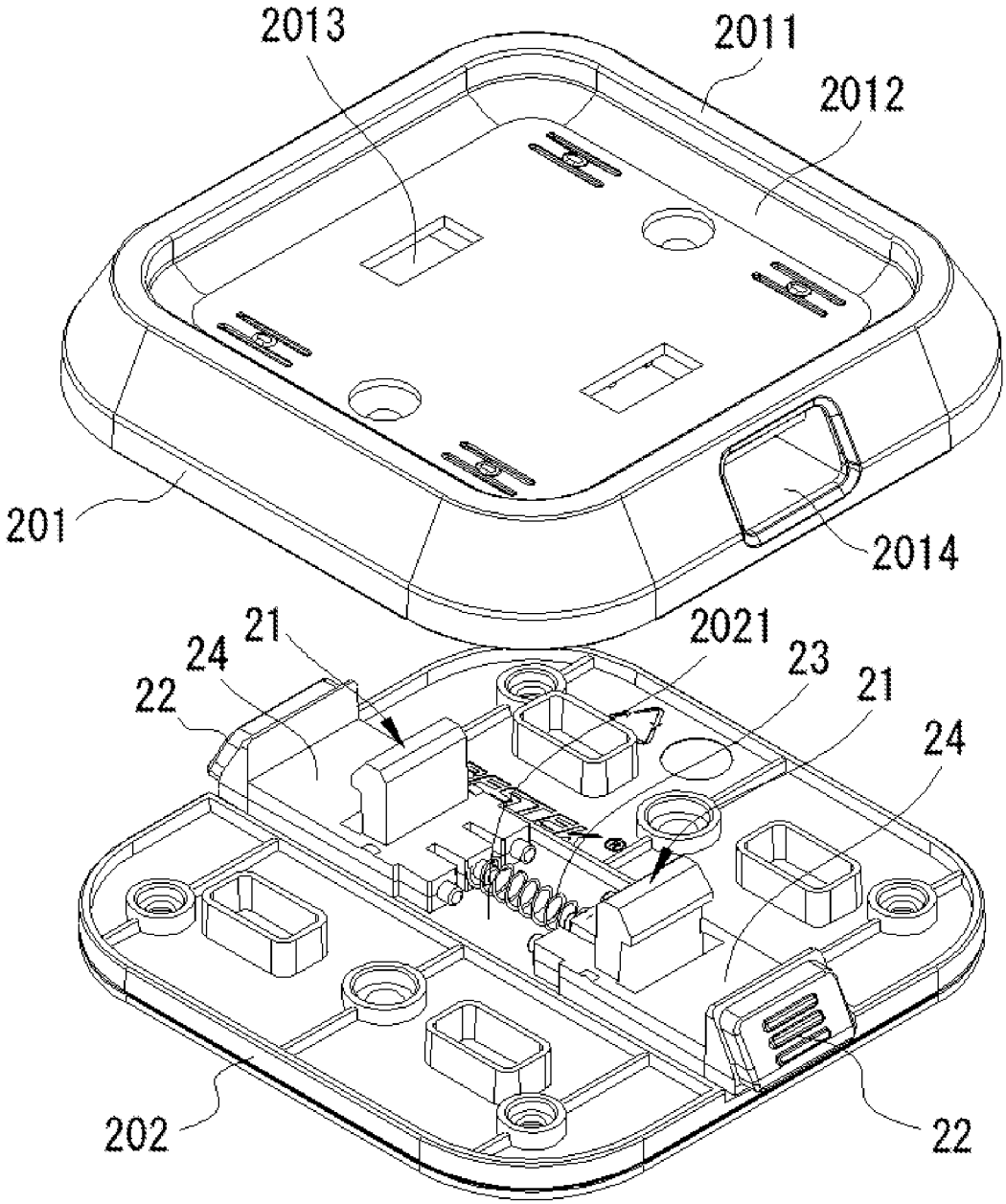
FIG. 3 is an exploded view of a fixed seat of the mobile socket device that can be quickly fixed and disassembled according to the embodiment of the present utility model.

In one embodiment of the present utility model as shown in FIGS. 2 to 3, the buckle 21 is configured to be slidable between a first position and a second position on the fixed seat 20. In the example as shown in FIG. 2, the buckle 21 moves between the first position and the second position in the left and right directions. The fixed seat 20 is provided thereon with an unlocking member for driving the buckle 21 to slide between the first position and the second position. When located at the first position, the buckle 21 is buckled with the clamp hole 1011, while when located at the second position, the buckle 21 is detached from the clamp hole 1011.

That is, the buckle 21 is slidably connected to the fixed seat 20 and can slide between the first position and the second position. At the same time, the fixed seat 20 is provided with the unlocking member, through which a user can exert a force to push the buckle 21 to slide between the first position and the second position. When the buckle 21 slides to the first position, it is buckled with the clamp hole 1011 on the socket 10. At this moment, the socket 10 can be fixed to the fixed seat 20. And when the buckle 21 slides to the second position, it detaches from the clamp hole 1011 of the socket 10. At this moment, the socket 10 can be removed from the fixed seat 20.

Thus, in a using procedure, the user can operate the unlocking member as needed to effectuate mounting and disassembly between the socket 10 and the fixed seat 20, which are simple and convenient.

As shown in FIGS. 2 to 3, more specifically, in one embodiment of the present utility model, the unlocking member comprises a pressure button 22 and an elastic member 23, wherein the pressure button 22 can be used to exert pressure upon the user's operation, the buckle 21 being connected to the pressure button 22; and the elastic member 23 is connected to the pressure button 22 to provide an elastic effect such that the buckle 21 remains at the first position.

That is, in the absence of an external force, the elastic member 23 is in a first compression state to provide a thrust to the pressure button 22, such that the pressure button 22 remains in an initial position, while the buckle 21 connected to the pressure button 22 remains at the first position, i.e., the buckle 21 and the clamp hole 1011 remain buckled to each other, and the socket 10 is fixed to the fixed seat 20. When the user exerts a pressing force on the pressure button 22, as the buckle 21 is connected to the pressure button 22, the pressure button 22 pushes the buckle 21 to move to the second position (rightwards as shown in FIG. 2). In such a procedure, the elastic member 23 is further compressed to form a second compression state. When the buckle 21 moves to the second position, it detaches from the clamp hole 1011, thereby effectuating unlocking. The socket 10 can thus be removed from the fixed seat 20. When the pressing force is withdrawn, the elastic member 23 resets to push the pressure button 22 to move backwards. The pressure button 22 then drives the buckle 21 to move to the first position (leftwards as shown in FIG. 2). Finally, the buckle 21 returns to the first position.

Thus, when the socket 10 is being fixed to the fixed seat 20, the buckle 21 can always be buckled with the clamp hole 1011 under the action of the elastic member 23, thereby ensuring firmness and reliability of the fixation of the socket 10 to the fixed seat 20. When the socket 10 is to be disassembled from the fixed seat 20, it is only necessary to press the pressure button 22. The operation is rather convenient, and meanwhile, the structure is simple and compact.

In one embodiment of the present utility model, the buckle 21 has a barb portion 211. The barb portion 211 has an inclined guide surface S01 configured to guide the barb portion 211 to be buckled into the clamp hole 1011.

In a specific using procedure, when the placement surface 101 of the socket 10 moves towards the receiving surface 2011 of the fixed scat 20 (the socket 10 moves downward in the example of FIG. 2), and when the socket 10 moves to a certain position, the inclined guide surface S01 contacts with a side wall of the clamp hole 1011. When the socket 10 continues to approach the fixed seat 20, said side wall of the clamp hole 1011 exerts a force on the inclined guide surface S01, forcing the buckle 21 to move in a direction close to the second position (the buckle 21 moves leftward in the example of FIG. 2) first. The inclined guide surface S01 slides along a side wall of the clamp hole 1011. At this moment, the elastic member 23 is first compressed, After the barb portion 211 extends into the clamp hole 1011, the elastic member 23 releases a certain length, and meanwhile the buckle 21 moves away from the second position (the buckle 21 moves rightward in the example of FIG. 2) until the barb portion 211 is buckled with the clamp hole 1011. The elastic member 23 keeps elastically acting on the pressure button 22 such that the barb portion 211 and the clamp hole 1011 remain in a buckled state.

As shown in FIGS. 2 to 3, advantageously, in one example of the present utility model, the receiving surface 2011 is provided with an accommodating slot 2012 to accommodate at least a portion of the socket 10. Preferably, the accommodating slot 2012 is sized to match the size of the socket 10. In this way, when the socket 10 and the fixed seat 20 are buckled with the clamp hole 1011 by means of the buckle 21, a bottom portion of the socket 10 is accommodated in the accommodating slot 2012. On the one hand, the socket 10 and the fixed seat 20 can be formed into an integral whole. On the other hand, a positioning role of the accommodating slot 2012, along with the buckling role between the buckle 21 and the clamp hole 1011, may effectuate a firmer and more reliable fixation between the socket 10 and the fixed seat 20.

In some embodiments of the present utility model as shown in FIGS. 2 to 3, the fixed seat 20 comprises an upper housing 201 and a lower housing 202. The upper housing 201 has the receiving surface 2011 provided with a travel hole 2013 that defines the first position and the second position. The lower housing 202 is connected to the upper housing 201, and is provided therein with a slideway 2021. The slideway 2021 is provided therein with a slider 24. The buckle 21 is arranged on the slider 24 and extends out from the travel hole 2013 to the accommodating slot 2012. The pressure button 22 is arranged on the slider 24 and at least partially exposed out from the fixed seat 20.

In the example of FIG. 3, the travel hole 2013 on the upper housing 201 is in the form of a long strip. One side wall in a width direction of the travel hole 2013 is defined to be the first position, while the other side wall in the width direction of the travel hole 2013 is defined to be the second position. A side wall of the upper housing 201 is provided with a keyhole 2014. The lower housing 202 and the upper housing 201 are connected to each other by means of a fastener such as a bolt. The slideway 2021 is formed at a middle position of the lower housing 202 and extends in left and right directions. The slider 24 is arranged in the slideway 2021 and can slide in left and right directions in the slideway 2021. The pressure button 22 is arranged at one end of the slider 24 and partially exposed out from the keyhole 2014, while the buckle 21 is arranged at the other end of the slider 24. The buckle 21 protrudes upward and extends out from the travel hole 2013 of the upper housing 201.

When the user exerts a force to press the pressure button 22, the pressure button 22 pushes the slider 24 to move rightward in a chute. Correspondingly, the buckle 21 moves rightward to the second position along with the slider 24. At this moment, the buckle 21 can be separated from the clamp hole 1011. Meanwhile, in this procedure, the elastic member 23 is compressed by the slider 24. And when the user withdraws the pressure, the elastic member 23 is reset to force the slider 24 to move leftward, thereby driving the buckle 21 to move leftward to the first position by means of the slider 24. At this moment, the buckle 21 and the clamp hole 1011 can be re-buckled.

In the present embodiment, the above structure can be used to ensure more convenient assembly, a simpler structure, and more smooth and reliable unlocking.

In one embodiment of the present utility model, two clamp holes 1011 are oppositely arranged, and two buckles 21 are arranged in one-to-one correspondence with the two clamp holes 1011. The two buckles 21 have opposite elastic reset directions. In the example of FIG. 3, two sliders 24 in the slideway 2021 of the lower housing 202 are oppositely arranged. One elastic member 23 is arranged between two sliders 24. Thus, the elastic action of the elastic member 23 enables the slider 24 to move in an opposite direction. Correspondingly, the buckle 21 can have an opposite elastic reset direction. Thus, the buckling between the two oppositely arranged buckles 21 and the clamp holes 1011 enables firmer and more reliable fixation between the socket 10 and the fixed seat 20.

In another embodiment of the present utility model as shown in FIGS. 2 and 4, four clamp holes 1011 are oppositely arranged to each other in pairs. And among the four clamp holes 1011, a distance between the two clamp holes in one pair of oppositely arranged clamp holes 1011 is equal to a distance between the two clamp holes in the other pair of oppositely arranged clamp holes 1011. Two buckles 21 are arranged in one-one-one correspondence with the two clamp holes 1011 in any pair of the oppositely arranged clamp holes 1011. And the two clamp holes 1011 have opposite elastic reset directions.

Thus, the socket 10 can be placed on the fixed seat 20 at one angle (e.g., 0 degree), and the two buckles 21 are buckled with two oppositely arranged clamp holes 1011, respectively. Meanwhile, the socket 10 can also be placed on the fixed seat 20 at another angle (90 degrees). At this moment, the two buckles 21 on the socket 10 can be buckled with the other two oppositely arranged clamp holes 1011. That is, the socket 10 can be placed on the fixed seat 20 at different angles, such that the two buckles 21 can be buckled with one pair of oppositely arranged clamp holes 1011. Thus, the mounting efficiency between the socket 10 and the fixed seat 20 can be improved. The position of the socket 10 at 90 degrees can be understood as the position of the socket 10 after 90 degrees of rotation from 0 degree along a vertical axis Z00.

It should be noted that the fixed seat 20 can be mounted to the carrier by means of a bolt, viscose bonding, or magnetic suction.

In one embodiment of the present utility model, the receiving surface 2011 is provided with a countersunk hole 2015 penetrating therethrough to the mounting surface. The countersunk hole 2015 is provided therein with a blot suitable for mounting the fixed seat 20 to the carrier. Thus, in a specific application, the blot can pass through the countersunk hole 2015 to be locked and fixed to a desktop or other carriers, the connection being firm and reliable.

In another embodiment of the present utility model, the mounting surface is provided with any one of double-sided glue, a magic sticker, and a magnetic member. In this way, in a specific application, double-sided glue, a magic sticker, or a magnetic member can be used for mounting to the desktop or other carriers, the connection being more convenient and simpler.

In the recitation of the present description, the recitation with reference to the terms "one embodiment," "some embodiments," "example," "specific examples," or "some examples" are intended to indicate that specific features, structures, materials, or characteristics described in connection with the embodiments or examples are included in at least one embodiment or example of the present utility model. In the present description, the exemplary expressions of the above terms are not necessarily to be directed to the same embodiments or examples. Moreover, the specific features, structures, materials, or characteristics described may be combined in appropriate manners in any one or more embodiments or examples. Furthermore, without contradicting each other, different embodiments or examples described in the present description and features described in the different embodiments or examples may be connected and combined by those of skill in the art.

The above is only preferred embodiments of the present utility model, and does not therefore limit the patent scope of the present utility model. Under the concept of the present utility model, equivalent structural transformation made from the contents of the description and drawings of the present utility model, or direct/indirect applications in other related technical fields, are all included in the patent protection scope of the present utility model.

What is claimed is:

1. A mobile socket device that can be quickly fixed and disassembled, comprising:

a socket having a placement surface located at a bottom of the socket and at least one power collecting surface, wherein the placement surface is provided with a clamp hole, and each power collecting surface is provided with at least one set of jacks; and a fixed seat having a receiving surface and a mounting surface, wherein the receiving surface is provided with a buckle buckled with the clamp hole, the buckle is configured to be slidable between a first position and a second position on the fixed seat, and the mounting surface is configured to be mounted to a carrier.

2. The mobile socket device that can be quickly fixed and disassembled according to claim 1, the fixed seat is provided thereon with an unlocking member for driving the buckle to slide between the first position and the second position, and when the buckle is located at the first position, it is buckled with the clamp hole, while when the buckle is located at the second position, it is detached from the clamp hole.

3. The mobile socket device that can be quickly fixed and disassembled according to claim 2, wherein the unlocking member comprises:

a pressure button for a user to operate to exert a pressure, the buckle being connected to the pressure button; and an elastic member connected to the pressure button to provide an elastic effect such that the buckle remains at the first position.

4. The mobile socket device that can be quickly fixed and disassembled according to claim 3, wherein the receiving surface is provided with an accommodating slot to accommodate at least a portion of the socket.

5. The mobile socket device that can be quickly fixed and disassembled according to claim 4, wherein the fixed seat comprises:

an upper housing having the receiving surface which is provided with a travel hole defining the first position and the second position; and a lower housing connected to the upper housing and provided therein with a slideway which is provided therein with a slider, the buckle being arranged on the slider and extending from the travel hole to the accommodating slot, the pressure button being arranged on the slider and at least partially exposed out from the fixed seat, and the elastic member being arranged in the lower housing.

6. The mobile socket device that can be quickly fixed and disassembled according to in claim 3, wherein two clamp holes are oppositely arranged to each other, and two buckles are arranged in one-to-one correspondence with the two clamp holes, the two buckles having opposite elastic reset directions.

7. The mobile socket device that can be quickly fixed and disassembled according to claim 3, wherein four clamp holes are oppositely arranged to each other in pairs, and among the four clamp holes, a distance between the two clamp holes in one pair of oppositely arranged clamp holes is equal to a distance between the two clamp holes in the other pair of oppositely arranged clamp holes; and two buckles are arranged in one-to-one correspondence with the two clamp holes in any pair of the oppositely arranged clamp holes, and have opposite elastic reset directions.

8. The mobile socket device that can be quickly fixed and disassembled according to claim 1, wherein the receiving surface is provided with a countersunk hole penetrating therethrough to the mounting surface, the countersunk hole being provided therein with a bolt suitable for mounting the fixed seat to the carrier.

9. The mobile socket device that can be quickly fixed and disassembled according to claim 1, wherein the mounting surface is provided with any one selected from a group consisting of double-sided glue, a magic sticker, and a magnetic member.

10. The mobile socket device that can be quickly fixed and disassembled according to claim 1, wherein the jacks comprise DC jacks and/or AC jacks.

11. The mobile socket device that can be quickly fixed and disassembled according to claim 1, wherein the buckle has a barb portion, the barb portion has an inclined guide surface configured to guide the barb portion to be buckled into the clamp hole.

12. The mobile socket device that can be quickly fixed and disassembled according to claim 5, wherein the upper housing is provided with a keyhole, the pressure button is disposed at one end of the slider and partially exposed out from the keyhole; the buckle is disposed at the other end of the slider and protrudes upward to extend out from the travel hole.

13. A mobile socket device that can be quickly fixed and disassembled, comprising:

a socket having a placement surface located at a bottom of the socket and at least one power collecting surface, wherein the placement surface is provided with a clamp hole, and each power collecting surface is provided with at least one set of jacks; and a fixed seat having a receiving surface and a mounting surface, wherein the receiving surface is provided with a buckle buckled with the clamp hole, and the mounting surface is suitable for being mounted to a carrier;

wherein the buckle is slidably connected to the fixed seat, the receiving surface is provided with a travel hole that defines a first position and a second position, the buckle is slidable between the first direction and the second direction in a direction parallel to the receiving surface.

14. The mobile socket device that can be quickly fixed and disassembled according to claim 13, wherein the fixed seat is provided thereon with an unlocking member for driving the buckle to slide between the first position and the second position, and when the buckle is located at the first position, the buckle is buckled with the clamp hole, when the buckle is located at the second position, the buckle is detached from the clamp hole.

15. The mobile socket device that can be quickly fixed and disassembled according to claim 14, wherein the unlocking member comprises:

a pressure button for a user to operate to exert a pressure, the buckle being connected to the pressure button; and an elastic member connected to the pressure button to provide an elastic effect such that the buckle remains at the first position.

16. The mobile socket device that can be quickly fixed and disassembled according to claim 15, wherein the fixed seat comprises:

an upper housing having the receiving surface; and a lower housing connected to the upper housing and provided therein with a slideway which is provided therein with a slider, the buckle being arranged on the slider and extending from the travel hole to the accommodating slot, the pressure button being arranged on the slider and at least partially exposed out from the fixed seat, and the elastic member being arranged in the lower housing.

17. The mobile socket device that can be quickly fixed and disassembled according to claim 15, wherein two clamp holes are oppositely arranged to each other, and two buckles are arranged in one-to-one correspondence with the two clamp holes, the two buckles having opposite elastic reset directions.

18. The mobile socket device that can be quickly fixed and disassembled according to claim 13, wherein the receiving surface is provided with a countersunk hole penetrating therethrough to the mounting surface, the countersunk hole being provided therein with a bolt suitable for mounting the fixed seat to the carrier.

19. The mobile socket device that can be quickly fixed and disassembled according to claim 13, wherein the buckle has a barb portion, the barb portion has an inclined guide surface configured to guide the barb portion to be buckled into the clamp hole.

20. The mobile socket device that can be quickly fixed and disassembled according to claim 15, wherein four clamp holes are oppositely arranged to each other in pairs, and among the four clamp holes, a distance between the two clamp holes in one pair of oppositely arranged clamp holes is equal to a distance between the two clamp holes in the other pair of oppositely arranged clamp holes; and two buckles are arranged in one-to-one correspondence with the two clamp holes in any pair of the oppositely arranged clamp holes, and have opposite elastic reset directions.

* * * * *